US010612342B2

(12) United States Patent
Abdollah et al.

(10) Patent No.: US 10,612,342 B2
(45) Date of Patent: Apr. 7, 2020

(54) PLUGGING TOOL, AND METHOD OF PLUGGING A WELL

(71) Applicant: Wellguard AS, Tyssedal (NO)

(72) Inventors: Jafar Abdollah, Trondheim (NO); Inge Manfred Carlsen, Trondheim (NO); Rune Flo, Trondheim (NO); Fridtjof Nyhavn, Trondheim (NO); Eirik Espe, Tyssedal (NO)

(73) Assignee: Wellguard AS, Tyssedal (NO)

( * ) Notice: Subject to any disclaimer, the term of this patent is extended or adjusted under 35 U.S.C. 154(b) by 88 days.

(21) Appl. No.: 15/758,684

(22) PCT Filed: Sep. 8, 2016

(86) PCT No.: PCT/NO2016/050185
§ 371 (c)(1),
(2) Date: Mar. 8, 2018

(87) PCT Pub. No.: WO2017/043977
PCT Pub. Date: Mar. 16, 2017

(65) Prior Publication Data

US 2018/0252069 A1 Sep. 6, 2018

(30) Foreign Application Priority Data

Sep. 11, 2015 (NO) ..... 20151176

(51) Int. Cl.
*E21B 33/134* (2006.01)
*E21B 28/00* (2006.01)
(Continued)

(52) U.S. Cl.
CPC ..... *E21B 33/134* (2013.01); *E21B 28/00* (2013.01); *E21B 33/124* (2013.01); *E21B 33/13* (2013.01)

(58) Field of Classification Search
CPC ..... E21B 33/13; E21B 33/124; E21B 33/134; E21B 28/00
See application file for complete search history.

(56) References Cited

U.S. PATENT DOCUMENTS 2,072,982 A 3/1937 Dale
3,335,801 A 8/1967 Wilsey
(Continued)

FOREIGN PATENT DOCUMENTS

EP 2006486 12/2008
GB 2414492 * 11/2005 ..... E21B 33/13
(Continued)

OTHER PUBLICATIONS

International Search Report and Written Opinion of PCT Application No. PCT/NO2016/050185 dated Dec. 20, 2016: pp. 1-12.

*Primary Examiner* — Yong-Suk Ro
(74) *Attorney, Agent, or Firm* — Chamberlain Hrdlicka

(57) ABSTRACT

A plugging tool and method of plugging a petroleum well permanently or temporarily is provided. The plugging tool, for instance, is used during a plug and abandonment operation (P&A) or during other operations where setting of a barrier in the well is required, by the use of a multitask tool. The multitasking nature enables the making and sealing verification of a plug in one trip. The multitasking tool comprising interconnected releasable sections, each comprising at least one packer arrangement, perforating means and a vibration device.

16 Claims, 9 Drawing Sheets

(51) Int. Cl.
*E21B 33/124* (2006.01)
*E21B 33/13* (2006.01)

(56) References Cited

U.S. PATENT DOCUMENTS

| | | | | |
|---|---|---|---|---|
| 5,152,342 | A | 10/1992 | Rankin et al. | |
| 5,469,918 | A * | 11/1995 | Haberman | E21B 33/134 166/291 |
| 2002/0157829 | A1 | 10/2002 | Davis et al. | |
| 2007/0256828 | A1 | 11/2007 | Birchak et al. | |
| 2008/0314591 | A1 | 12/2008 | Hales et al. | |
| 2013/0245948 | A1* | 9/2013 | Nyhavn | E21B 27/02 702/6 |
| 2015/0053405 | A1 | 2/2015 | Bakken | |

FOREIGN PATENT DOCUMENTS

| | | |
|---|---|---|
| GB | 2414492 | 3/2008 |
| WO | 2012096580 | 7/2012 |
| WO | 2015115905 | 8/2015 |
| WO | 2015153655 | 10/2015 |

* cited by examiner

PLUGGING TOOL, AND METHOD OF PLUGGING A WELL

FIELD OF THE INVENTION

The invention concerns the field of plugging tubular members. More specifically, the inventions concerns a tool and a method of plugging a hydrocarbon well permanently or temporary, for instance, during a plug and abandonment operation (P&A) or during other operations where the setting of a barrier in the well is required.

BACKGROUND OF THE INVENTION

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production testing of the well can begin.

Hydrocarbon wells for the exploitation of oil and/or gas from a reservoir normally consist of an upper and outer conductor, which forms the base of the well, an upper casing arranged into and in extension of the conductor, and further down in the well more casings which are arranged into and overlaps the above casing. A production tubing string is located in the middle of the well for transporting petroleum from the bottom of the well to the earth s surface or to the sea floor. Annuli will then be formed between the different casings.

As the production from a well gradually falls, all wells will sooner or later have to be abandoned. Before the well is permanently abandoned, the well must be securely plugged, where there are official requirements with respect to how the work is to be carried out and to its completion. For this purpose, normally cement plugs are used to provide a barrier in the well.

First decision is if the production tubing string in the middle of the well must be pulled. This is a requirement if cables are un on its outside. Without cables, production tubing could be left to save operational time. This will then add one extra annulus.

A common requirement during plug-and-abandonment operations is to have a plug set inside an inner casing string and a further plug set in the annulus between the inner casing string and the outer casing string (or borehole formation). The plug will then extend across the full cross sectional area of the well.

Normally, one of the following methods and technologies are used to install a cross sectional cement barrier and thus plug and abandon hydrocarbon wells: (1) Section casing milling; (2) Squeezing cement by use of perforation and cement retainer; and (3) the Perforation, Washing, and Cementing (PWC) technique.

The section casing milling is common practice, running a mill (similar to bit) in the borehole on a drill string (drill-pipe) and milling the casing at the desired well depth. While milling, drilling fluid is pumped down and circulating to clean the well from the metal debris. Several trips are needed to replace a worn mill with the new mill to mill out a required interval (ca. 100 m for a combined plug). Large volume of swarf (debris or waste resulting from the milling) is produced, and handling the swarf is a complex procedure.

After milling operation is completed, part of the hole section will become fully exposed to the formation rock (open-hole). An under-reamer is run to enlarge the open hole and clean the well prior to cementing. The required cement volume is pumped down through a drill-string and placed in the open-hole section. The cement is then tested and verified as a rock-to-rock barrier.

Disadvantages of the section casing milling method include:

- Time consuming, many rig days (ca. 21-30 days for a 100 m plug);
- Risk of swarf and debris handling;
- Potential for swarf damaging the blow-out preventer (BOP);
- Risk of pipe getting stuck due to poor hole cleaning (because of swarf);
- Several trips are required to change the mill.

With the technique in which cement is squeezed by use of perforation and a cement retainer, the casing can be perforated conventionally in two different depths, e.g. approximately 100 m apart. Normally, one perforation is provided and circulation will normally go through the entire annulus to the surface. The cement retainer is a special plug which is used to squeeze cement through it, and hold pressure to prevent back-flow of cement ("U-tube effect") after cement has been injected. The cement retainer is run separately, via wireline, coiled tubing or drill-string. In general, a cement retainer is an isolation tool set in the casing or liner that enables treatments to be applied to a lower interval while providing isolation from the annulus above. Cement retainers are typically used in cement squeeze or similar remedial treatments. A specially profiled probe, known as a stinger, is attached to the bottom of the tubing string to engage in the retainer during operation. When the stinger is removed, the valve assembly isolates the wellbore below the cement retainer.

Disadvantages with this technique include:

- It is difficult to verify new annulus cement as the perforation is plugged by cement which remains below the cement retainer;
- Multiple trips required.

The so-called PWC technique may be done in one trip. It consist of perforating the section with guns; washing the perforated section; then placing the cement plug. To avoid some of the disadvantages listed below, drilling the perforation could be an option, but then more time consuming.

Disadvantages associated with the co-called PWC technology include:

- May damage the casing;
- Unable to perform cement bond log (CBL);
- Unable to verify new annulus cement barrier;
- Extended operation time; multiple trips required (typically four trips for a 100 m plug);
- Use of explosives;
- Extreme caution may be necessary (nearby producer wells may have to be shut off).

The known methods of performing annular sealing during temporary or permanent plugging of hydrocarbon wells are all having the goal of placing cement in the annulus in a secure and safe manner via either holes in the tubular or by directly pumping in the annulus: a) so-called shoot and squeeze, which displaces the fluid by use of an open-ended drill pipe or tubing, b) top down cementing, c) circulation squeeze, d) hesitation squeeze. All of the above methods a)-d) have challenges relating to conforming the cement over the full interval, this relates both to the placing as well as the logging. The placing of the cement is not conclusive as the cement will have to change place with the annulus fluids present in the annulus prior to placing barrier cement. The fluid which is present in the annulus needs to be evacuated/forced to either above or below the interval or through the formation rock by formation leak-off.

The current logging technologies. e.g. Ultra-Sonic Imager Tool (US IT). Cement Bond Log (CBL). Segmented Bond Tool (SBT), have proven very subjective regarding being to able to conclusively confirming or verifying that the barrier is sealing properly in the annulus. The current designs of today's logging tools are fully dependent on a logging-friendly downhole environment, i.e. the environment needs to fulfill certain demands to be able to perform a proper logging operation.

The prior art includes WO 2012/096580 A1, which describes a method and washing tool for combined cleaning of an annulus in a well across a longitudinal section of the well, and subsequent plugging of the longitudinal section.

US 20150053405 describes a method where the cement is placed into the tubular whereafter the cement is pressurized out of the tubular and into the annulus.

U.S. Pat. No. 2,072,982 describes a method where the cement charge is subjected to the action of a mechanical vibrator while driving the cement into an annulus through perforations in the casing.

U.S. Pat. Nos. 5,152,342 and 3,335,801 describe methods where devices are located on the casing string. Some of the cement will flow through a bypass section to power the devices and cause vibrations in the casing steel. As with vibrations in the cement, the objective is to gain better cement bonding. Being mechanical devices, the techniques are limited in frequency selection and bandwidth.

It is therefore a need for a plugging tool and method that can simplify the plugging process.

SUMMARY OF THE INVENTION

The invention is set forth and characterized in the main claim, while the dependent claims describe other characteristics of the invention.

It is thus provided a plugging tool for use in a tubular, comprising tool conveyance means, control means and fluid conveyance means, and further comprising at last one internal conduit, fluidly connected to the fluid conveyance means, and having one or more openings, wherein the plugging tool is characterized by

- a first section and a second section, interconnected by releasable connection means, and the first section comprising said openings;
- at least one respective packer arrangement on each section, each packer arrangement being configured for releasable abutment with a portion of the tubular inner wall;
- perforating means, arranged between said packer arrangements, and configured to perforate the tubular wall in a controlled manner such that the tubular is not deformed or otherwise damaged and thus forming perforations in the tubular wall.

In one embodiment, the plugging tool further comprises a vibration device, configured for imparting vibrations to the plugging tool. The plugging tool may also comprise an extendable and retractable device for transferring vibrations from the vibration device to a structure in the vicinity of the plugging tool, for example the tubular wall. The plugging tool may also comprise an extendable and retractable device for converting vibrations from the vibration device to pressure pulses in the pumped matter.

The plugging tool may comprise sealing means configured for releasable sealing of said perforations. The perforating means and sealing means may be integrated. The perforating means may comprises drilling means, milling means, or jetting means.

It is also provided a method of plugging a well having at last one tubular, with the invented plugging tool, characterized by the steps of:

a) conveying the plugging tool to a desired plugging zone in the tubular;

b) activating a packer arrangement on the second section into abutment with the tubular inner wall, thereby fixating the plugging tool in the tubular;

c) operating the releasable connection means to separate the first section from the second section;

d) flowing a plugging substance through the opening and into the tubing-internal cavity between the second section and the first section;

e) retrieving the first section from the tubular.

In one embodiment, before step b), one or more first perforations are formed in the tubular wall at a first end of the plugging zone, and one or more second perforations are formed in the tubular wall at a second end of the plugging zone, and the second perforations are formed between the locations of the packer arrangements.

Following or concurrent with step b), a packer arrangement on the first section may be activated.

Following the activation of the packer arrangement on the second packer but before step c), fluids may be flowed from the opening, through the second perforations and into a formation outside the tubular, and into the tubular through the first perforations.

The perforations may be formed by drilling means, milling means, or jetting means.

The tubular may be a casing and the plugging substance may be cement.

The invented plugging tool is modular and capable of performing all necessary downhole tasks in one trip. This results in a considerable time and cost savings, compared to the prior art methods. The plugging is performed without damaging or deforming the well casing walls, which means that casing holes can be temporarily plugged for pressure testing during the procedure. The ability to perforate the casing without damaging the casing wall per se, also enables CBL logging (Cement Bond Log) to verify the condition of the annulus cement before the internal volume is filled with cement. The vibrating device on the invented tool also improves cement flow and bonding.

The invented plugging tool may thus be referred to a multitask tool. The tool's multitasking nature enables the making and scaling verification of a plug in one trip only.

BRIEF DESCRIPTION OF THE DRAWINGS

These and other characteristics of the invention will become clear from the following description of a preferential form of embodiment, given as a non-restrictive example, with reference to the attached schematic drawings, wherein.

DETAILED DESCRIPTION OF A PREFERENTIAL EMBODIMENT

Figure 1A:
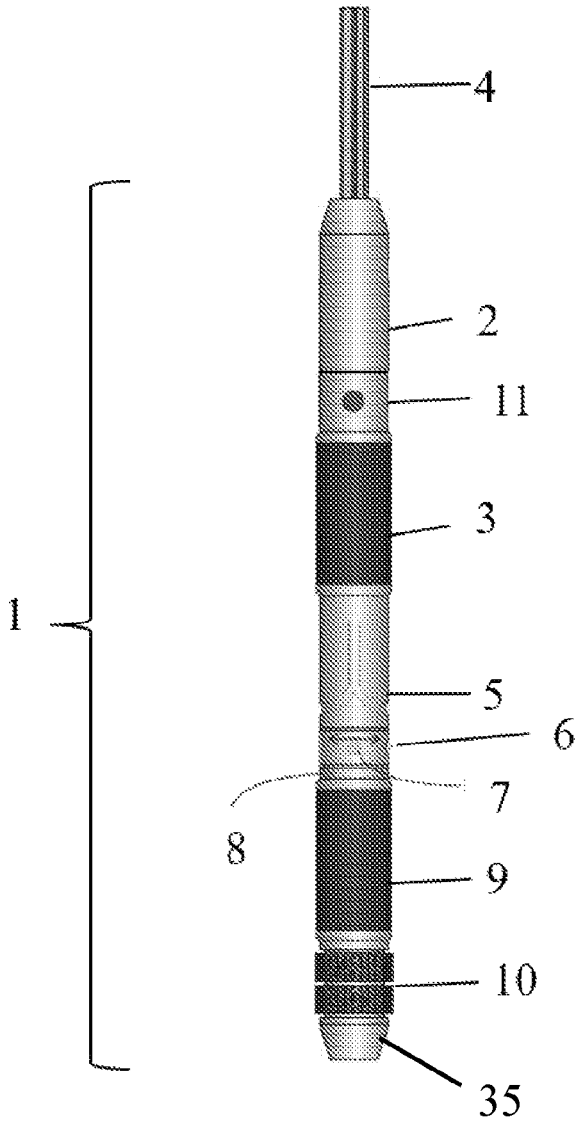
FIG. 1*a* is a side view of an embodiment of the invented plugging tool in an assembled state.

The following description will use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

Figure 1B:
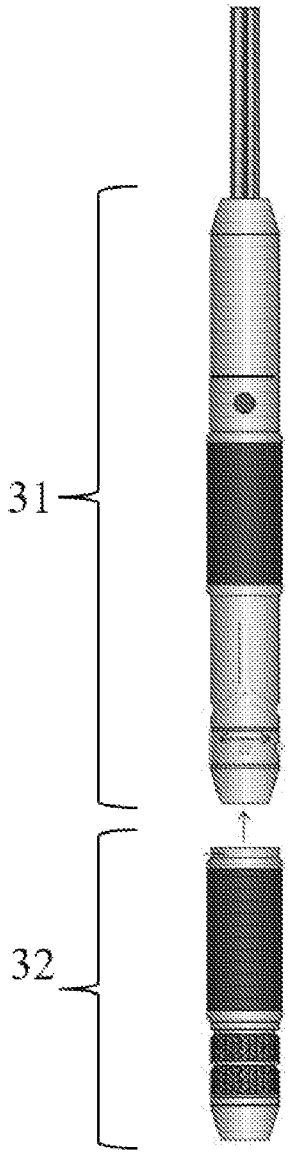
FIG. 1*b* is a side view of the plugging tool shown in FIG. 1*a*, separated in two sections.

FIG. 1*a* and FIG. 1*b* show an embodiment of the invented plugging tool 1. The plugging tool is conveyed (in the casing) and controlled via coiled tubing 4. The plugging tool comprises two main sections 31, 32, releasably interconnected by a quick-disconnect mechanism 8 (which per se is known in the art). In FIG. 1*b*, the lower section is referred to as a non-retrievable section 32 and the upper section is referred to as a retrievable section 31.

The plugging tool comprises a vibration generator 2 and a mechanical actuator 11. The vibration generator 2 may be based on magnetostrictive materials (e.g. Terfenol B) whereby no movable parts are required and broadband frequency vibrations are obtained. In another embodiment, the vibration generator 2 may be based on mechanical principles (e.g. rotating, unbalanced wheel). The mechanical actuator 11 is configured to be radially extendable (not shown in FIGS. 1*a,b*) so as to come into contact with an adjacent structure (e.g. casing wall). Vibration signals and energy from the vibration generator 2 may be transferred to the mechanical actuator 11 by solid rods, hydraulic lines, and/or electrical wires. The vibration generator 2 and mechanical actuator 11 may also be one integrated unit.

The plugging tool 1 comprises two packer arrangements 3, 9. It should be understood that the packer arrangements may contain one or more single packer elements, capable of radial extension and retraction, as is known in the art. In the illustrated embodiment, one packer arrangement 3 is connected to the retrievable section 31; it will hereinafter be referred to as an upper packer 3. The other packer arrangement 9 is connected to the non-retrievable section 32; it will hereinafter be referred to as a lower packer 9.

Reference number 5 indicates channel sections being fluidly connected (via internal conduits) to the coiled tubing, and having openings as shown in FIG. 1*a*. Various fluids may thus be flowed through the plugging tool.

Reference number 6 indicates a drilling tool, being integrated with a sealing plug 7. The drilling tool is configured to make controlled perforations in tubular walls (e.g. casing). Other, similar drilling or milling means are thus equally applicable. As will be shown and described below, the drilling or milling device preferably comprises a conical shape, in order to minimize the risk of getting stuck.

Scraper brushes 10 are arranged near the lower end of the plugging tool, and the plugging tool terminates with a tapered guide nose 35.

Although not shown, the plugging tool 1 may be equipped with a CBL unit (Cement Bond Logging) for logging the quality of annulus cement.

A method of using the invented plugging tool 1 will now be described with reference to FIGS. 2-11.

Figure 2:
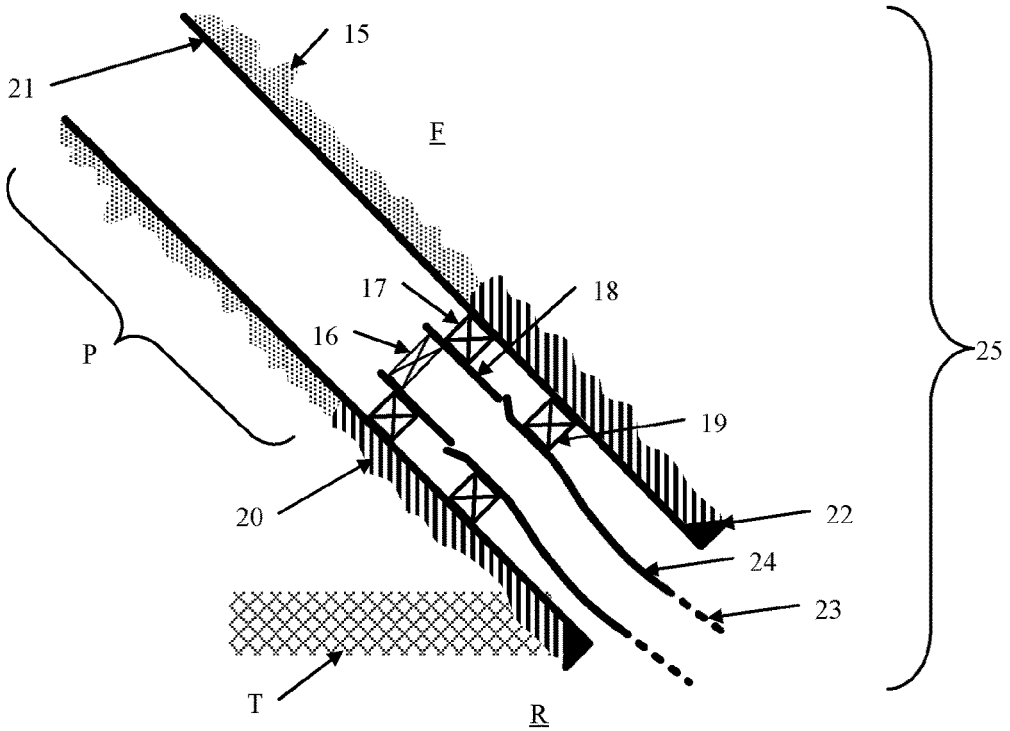
FIG. 2 is a side view of a wellbore in a subterranean formation, in which a bridge plug has been installed in a completion tubing above a reservoir, and the completion tubing is connected to a wellbore casing.

FIG. 2 is a schematic illustration of a well 25 which has been prepared for a plugging-and-abandonment (P&A) operation. It should be understood that FIG. 2 only shows a portion of the well, as the borehole and casing normally extend through the formation F for several hundred metres to the terrain surface. It should also be understood that this terrain surface may below a body of water (i.e. a seabed) or on dry land. The equipment and procedures used to run and operate downhole tools are well known in the art and will therefore not be described here.

Thus, in FIG. 2, the well 25 comprises a casing 21 which extends into a reservoir R below a cap rock T, i.e. the upper part of the reservoir. The casing 21 may be a 9⅝" casing, but the invention shall not be limited to this dimension. The casing terminates into the reservoir at a casing shoe 22 and is fixed to the surrounding formation via casing cement 20. Above a completion tubing 18, an annulus with mud 15 is formed between the casing outer surface and the surrounding formation. The completion tubing 18 is connected to the casing inner wall via a completion packer 17. A production liner 24, in fluid connection with the completion tubing, is connected to the casing inner wall via a liner hanger 19 and is in turn fluidly connected to a screen 23 extending into the reservoir. A bridge plug 16 has been installed in the completion tubing. The well is ready to be plugged in the zone denoted P in FIG. 2.

Figure 3:
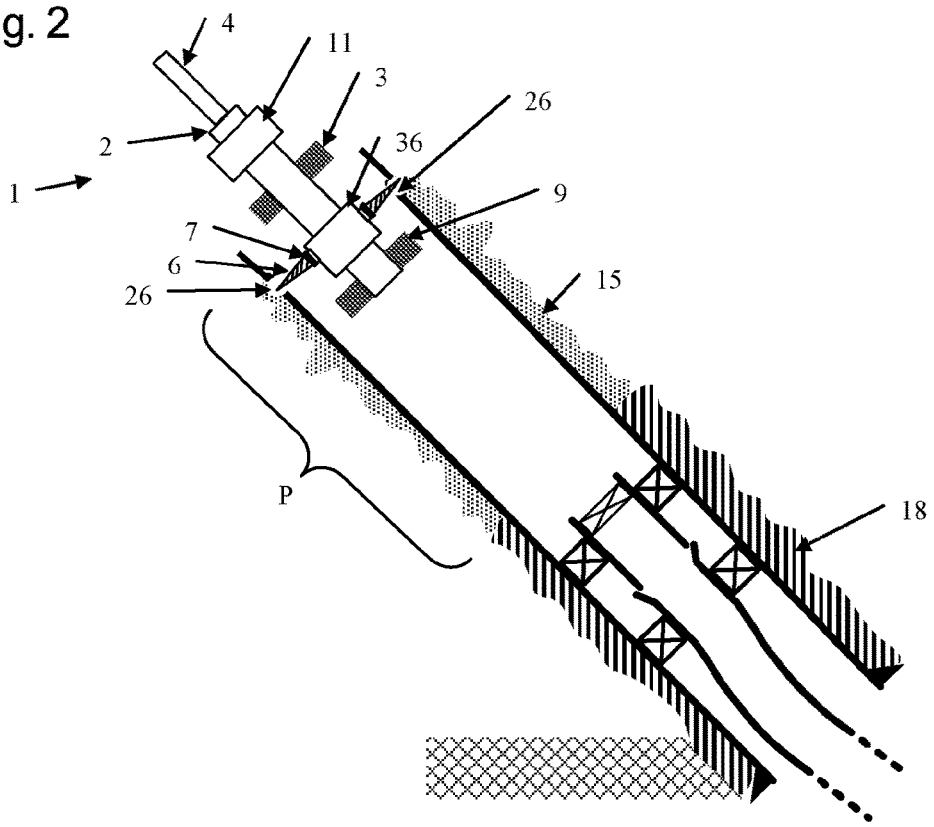
FIG. 3 is a side view of an embodiment of the invented plugging tool, forming perforations in the casing wall of an upper region of the volume to be plugged.

FIG. 3 shows an embodiment of the invented plugging tool 1 as it is has entered the upper part of the plugging region P. Although not illustrated, it should be understood that the plugging tool is conveyed down the casing and controlled from a surface location, in a manner which per se is known in the art, via e.g. coiled tubing 4. So-called "E-line coiled" tubing is advantageously used with the invention. A vibration generator 2 and a mechanical actuator 11 are arranged at the upper part of the plugging tool. Two packers 3, 9 are arranged on the plugging tool with an axial distance apart, hereinafter for the sake of convenience being referred to as the upper packer 3 and lower packer 9, respectively. A drilling section 36 is arranged between the upper and lower packers 3, 9. The drilling section, which comprises a drilling tool (or a milling tool, or a jetting tool) 6 that per se is well known in the art, is configured to perforate the casing in a controlled manner such that the casing wall is not deformed or otherwise damaged. The drilling tool 6 also comprises sealing plugs 7, indicated as black lines on the drilling tool. It should therefore be understood that the drilling section may comprise any perforating device that can perforate the casing in a controlled manner such that the casing wall is not deformed or otherwise damaged.

In FIG. 3, the drilling tool 6 is extended and has made perforations 26 in the casing, providing an opening between the casing interior and the mud 15 outside the casing. These perforations will for the sake of convenience hereinafter be referred to as upper perforations 26.

Figure 4:
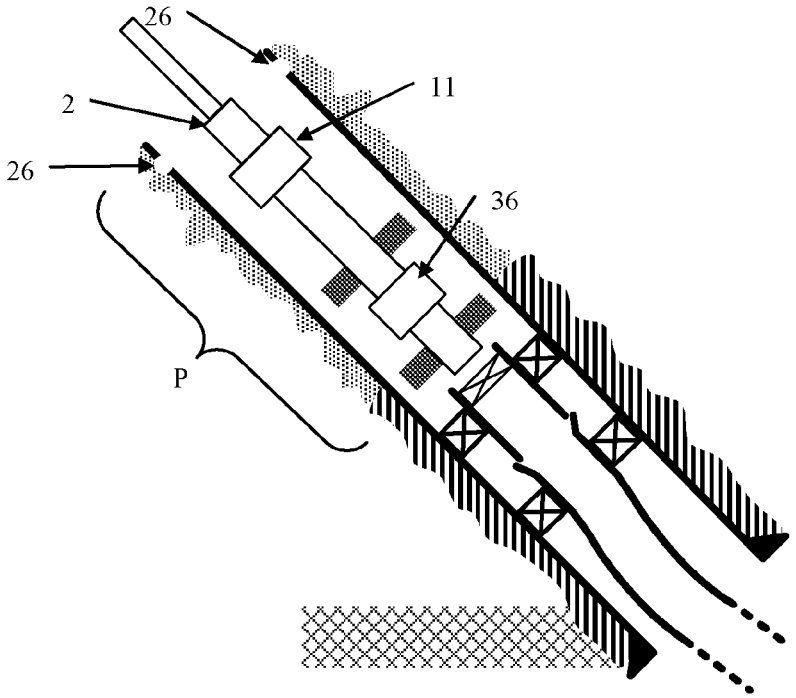
FIG. 4 is a side view in which the plugging tool has been moved closer to the bridge plug.
Figure 5:
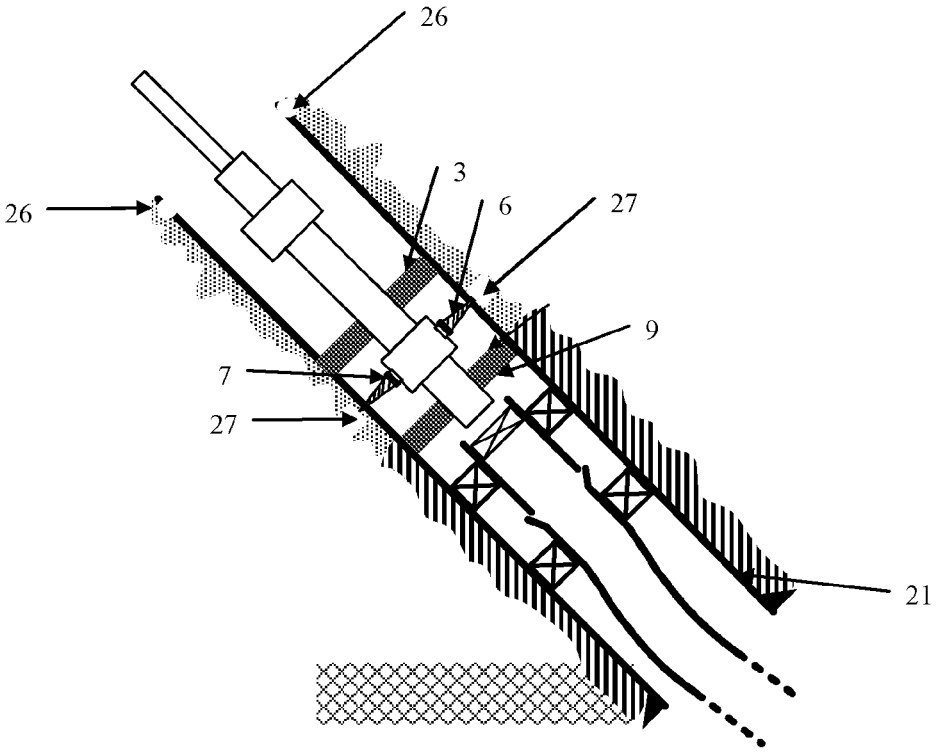
FIG. 5 is a side view of the plugging tool, set in the casing via packers, and forming perforations in the casing in a lower region of the volume to be plugged.

In FIG. 4, the drilling tool has been retracted into the drilling section 36 and the plugging tool 1 has been moved further into the plugging zone P. FIG. 5 illustrates a next step in the process, in which the plugging tool 1 is set in the casing 21 via the upper and lower packers 3, 9, and the drilling tool 6 extended to make lower perforations 27 in the casing wall, in a manner similar to making the upper perforations.

Figure 6:
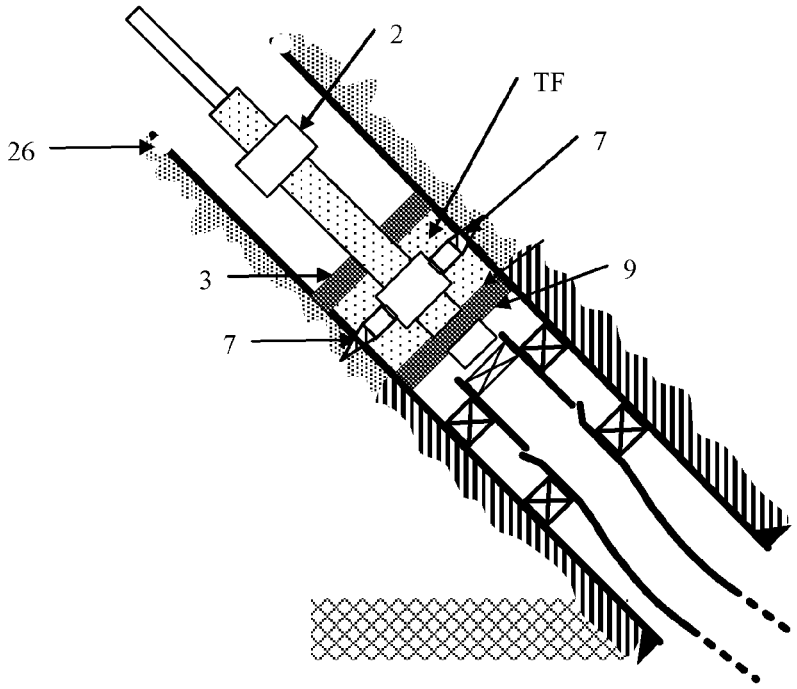
FIG. 6 is a side view of the plugging tool in the position as shown in FIG. 5, illustrating how test fluid is injected into the annulus defined by the plugging tool, the casing and the upper and lower packers.

After the upper and lower packers 3, 9 have been set and the upper and lower casing perforations 26, 27 have been made as described above, the lower perforations are sealed by the sealing plugs 7, as illustrated in FIG. 6. A test fluid TF is injected into the cavity between the packers 3, 9 to test the seals and packers. The injection is performed in a manner known in the art per se, through the coiled tubing and conduits inside the plugging tool 1. Thereafter (not illustrated), the sealing plugs are retracted and circulation is established out of the lower perforations and in through the upper perforations, to clean the annulus between the casing and the formation. Optionally, the vibration generator 2 may be activated during this cleaning process.

Figure 7:
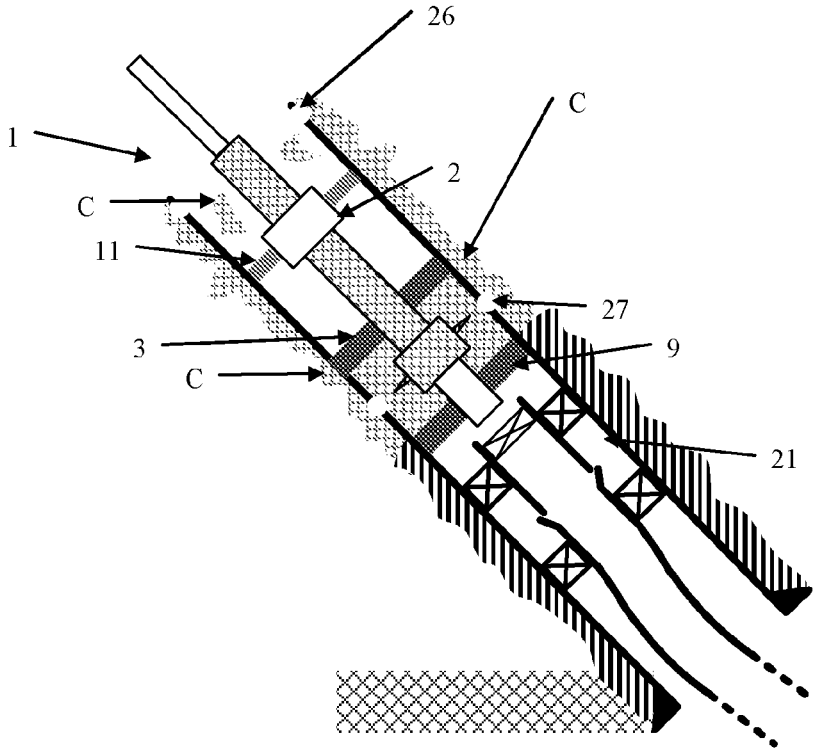
FIG. 7 is a side view of the plugging tool when cement is being injected into the lower perforations, displacing mud outside the casing and entering the casing through the upper perforations.
Figure 8:
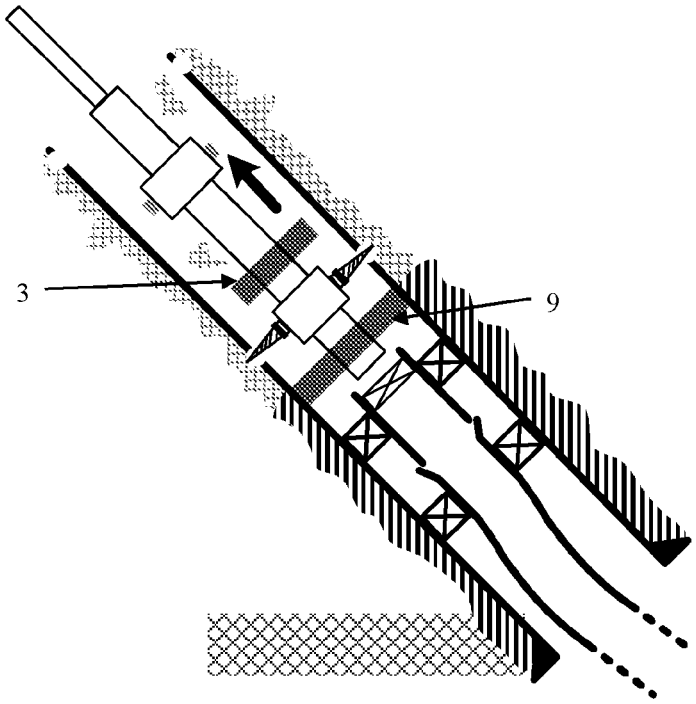
FIG. 8 is a side view of the plugging tool in a state where the upper packer has been retracted and the sealing plugs have been inserted into the lower perforations, and a displacement fluid is pumped via the coiled tubing channel to empty cement out of the well.
Figure 9:
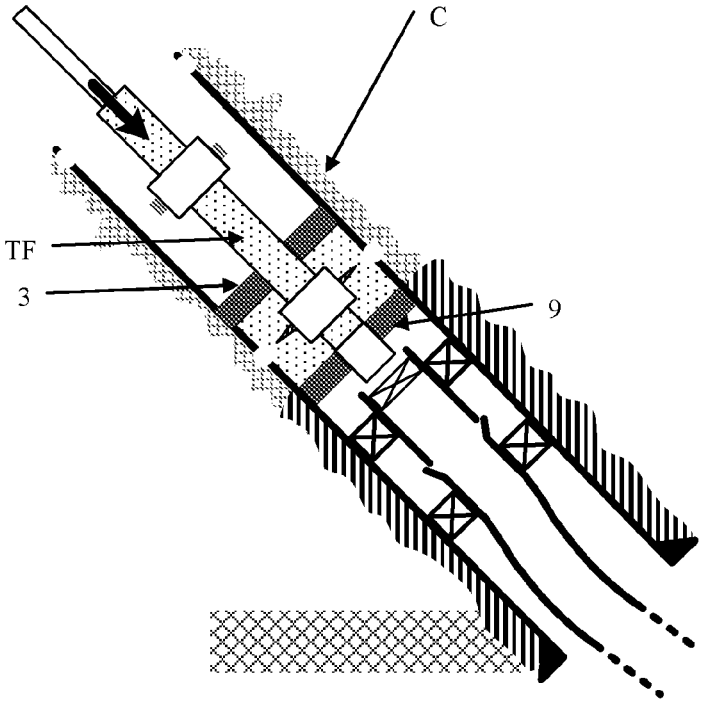
FIG. 9 is a side view in which the sealing plugs (or milling tools) have been retracted, and a test fluid is injected into the annulus defined by the tool, the casing and the upper and lower packers, in order to verify the annulus cement.

FIG. 7 illustrates cement C being pumped through the coiled tubing and though internal conduits in the plugging tool 1, and into the cavity between the upper and lower packers 3, 9. The cement C is then forced through the lower perforations 27, through the annulus between the casing and the formation, and into the casing through the upper perforations 26. During this process the mechanical actuators 11 on the vibration generator 2 is extended to contact the casing wall, thereby imparting vibrations to the casing wall and the cement C surrounding the casing. This cement pumping process is advantageously executed a comparably low flow rates, in order to allow the cement penetrate into the formation. When cement pumping has been completed, the lower perforations 27 are once again sealed, using the sealing plugs 7, and the upper packer 3 is retracted while the lower packer 9 remains set. This stage is illustrated in FIG. 8, also showing (indicated by the arrow) how the region above the lower packer is circulated with a cleaning fluid in order to remove residual cement in that region. FIG. 9 illustrates how test fluid TF is pumped into the cavity between the packers 3, 9, to verify the integrity of the cement C.

Figure 10:
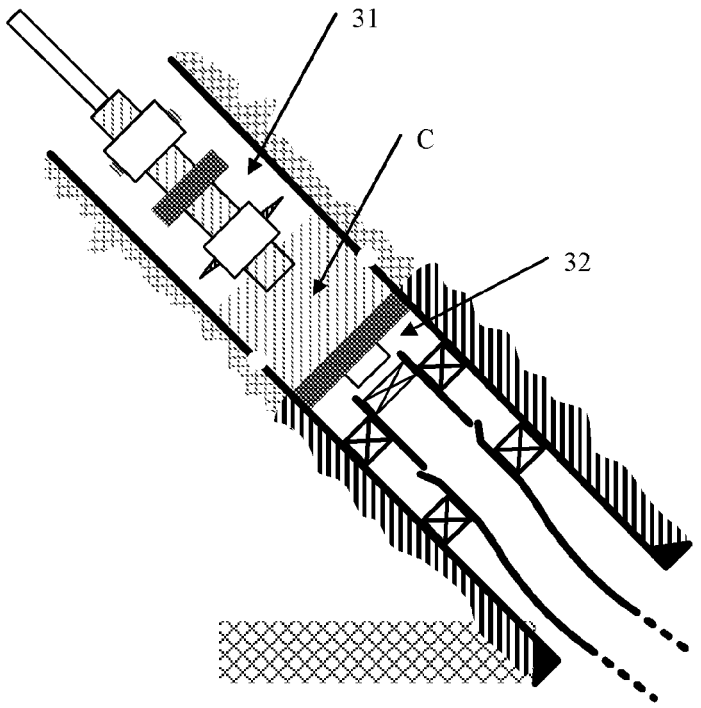
FIG. 10 is a side view showing the upper packer has been retracted and the lower section of the plugging tool remains set (by the lower packer) towards the casing, while the upper section of the plugging tool is pulled upwards while cement is pumped into the volume between the two tool sections.

In FIG. 10, the quick-disconnect mechanism 8 (see FIG. 1*a*) has been operated and the plugging tool 1 has been separated into the retrievable section 31 and the non-retrievable section 32. The retrievable section 31 has been pulled (by the coiled tubing) a distance away from the non-retrievable section 32 and cement is being pumped into the cavity between the two sections. During this process, the vibration generator 2 may be operated, to impart vibrations to the cement through the plugging tool body, or to the casing wall (using the mechanical actuators), or both.

Figure 11:
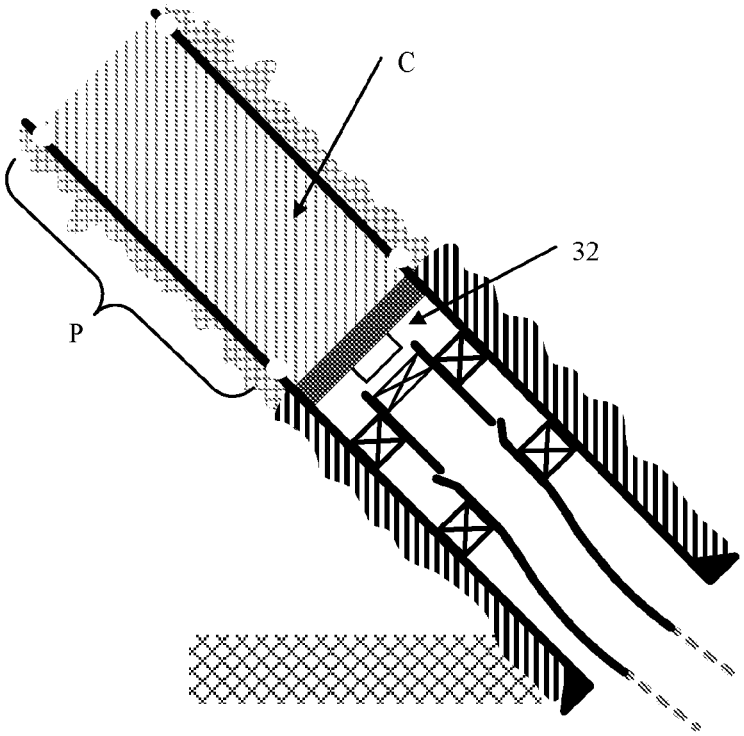
FIG. 11 is a side view showing the completed cement plug and the lower sections of the tool; the upper part of the section having been removed.
Figure 12:
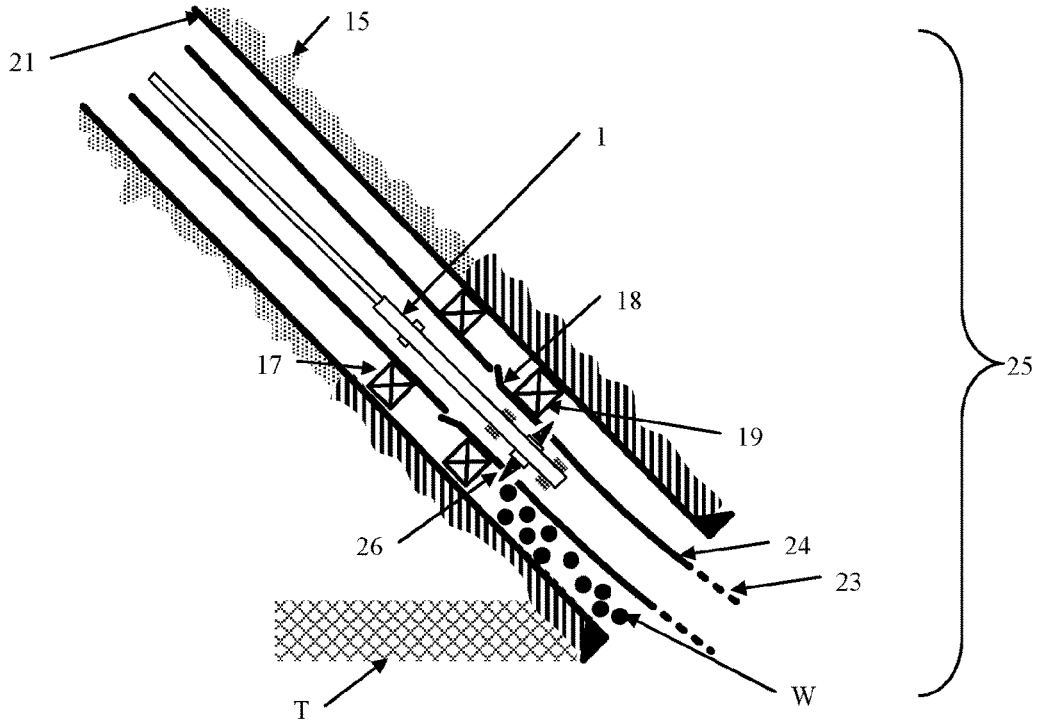
FIGS. 12-16 illustrate an alternative application of the plugging tool, in setting a plug below the completion packer.
Figure 13:
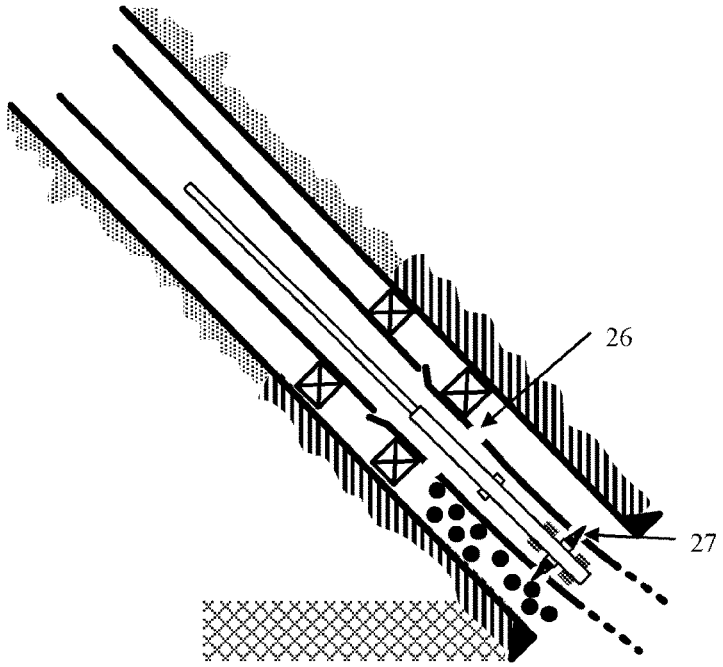
Figure 14:
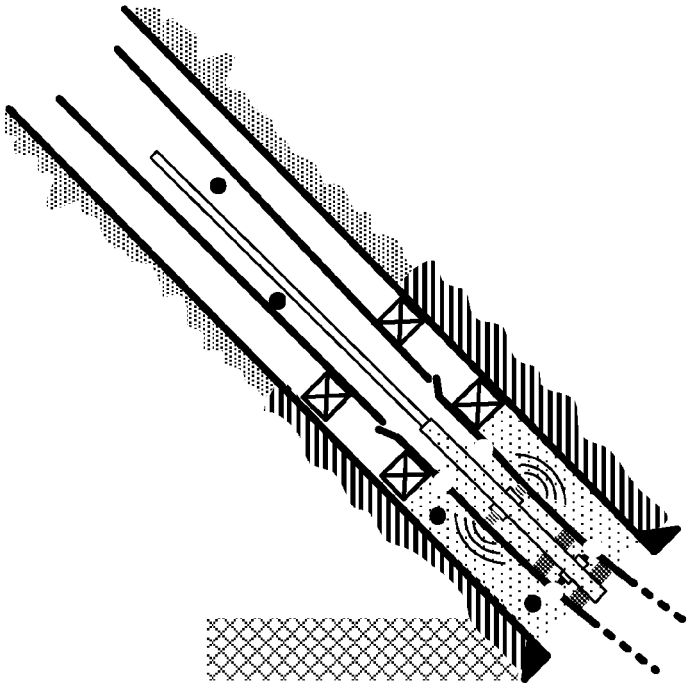
Figure 15:
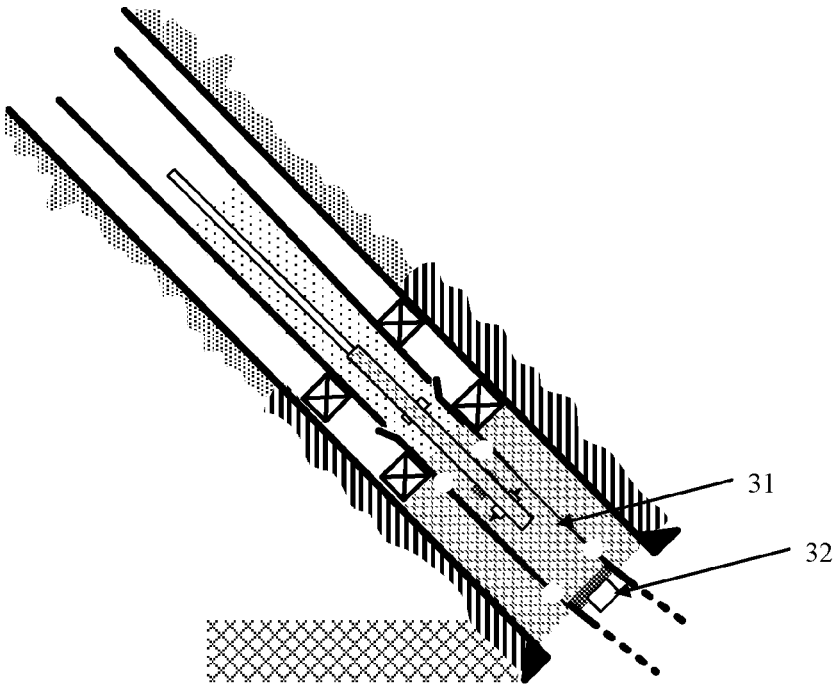

In FIG. 11, the retrievable section has been removed, and cement C is filling the plugging zone P. The non-retrievable section 32, with its packer 9 in the set position, forms a foundation for the cement plug.

It should be understood that the steps described above are only one example of a method of using the plugging tool. The skilled person will understand that the number and sequence of steps depend on the actual case at hand. For example, given the appropriate well conditions, the plugging tool may be used to place a cement plug below the liner hanger. This is illustrated in FIGS. 12-16 (showing only a selection of steps) where:

- upper perforations 26 are formed in the tubing, below the liner hanger 19 (FIG. 12);
- lower perforations 27 are formed in the tubing, as distance below the upper perforations (FIG. 13);
- circulation flow is established, and vibration is applied to the tubing, to clean annulus (figure (14);
- pressure applied via coiled tubing to verify annulus cement (FIG. 15); and
- upper section 31 (not set) is disconnected from lower section 32 (set in tubing), and cement is pumped inside casing.

Figure 16:
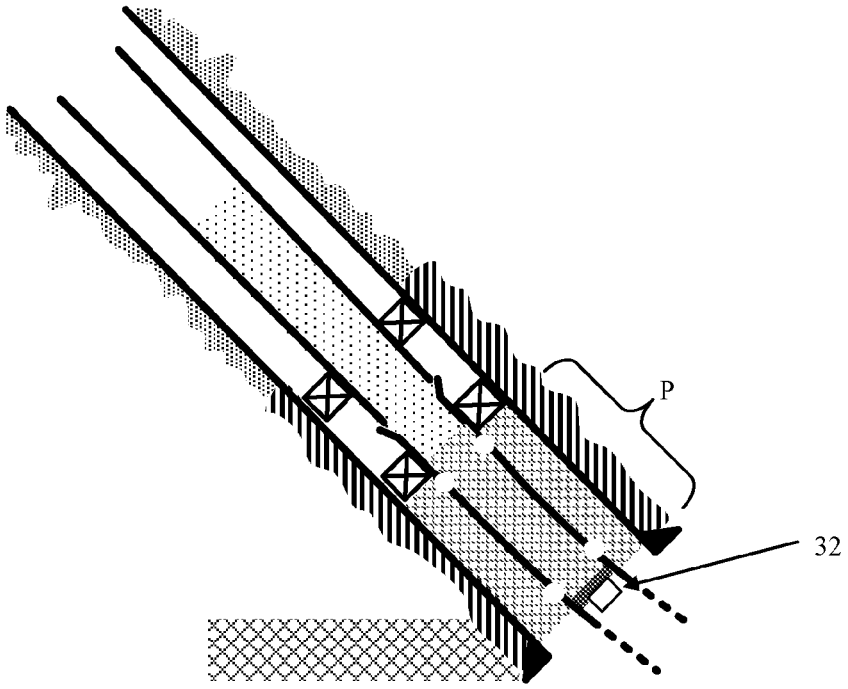

FIG. 16 illustrates the completed plug.

In general, the plugging tool may be used to place a plug in any tubular and annulus.

The invented plugging tool makes it possible to plug a well in only one trip. It should be noted, however, that if the plugging is not successful, for example due to lack of circulation, the non-retrievable section 32 may be abandoned, and the retrievable section 31 may be retrieved, fitted with a new non-retrievable section and the complete plugging tool may be conveyed to a different location in the well, and the above procedure repeated.

While the invention has been described with reference to an annulus between a casing and a formation, it should be understood that the invention is equally applicable for installing a plug in a well having multiple casings.

The invention claimed is:

1. A plugging tool for use in a tubular having an inner wall, the tool comprising:

- a tool conveyance means;
- a control means; a fluid conveyance means;
- at last one internal conduit fluidly connected to the fluid conveyance means and comprising one or more openings;
- a first section and a second section interconnected by releasable connection means, and the first section comprising said openings;
- at least one respective packer arrangement on each of the first and second sections, each packer arrangement being configured for releasable abutment with a portion of the tubular inner wall, wherein the first section is a retrievable section and the second section is a non-retrievable section; and
- a drilling section arranged between the packer arrangements and configured to form perforations in the tubular wall.

2. The plugging tool of claim 1, further comprising a vibration device configured for imparting vibrations to the plugging tool.

3. The plugging tool of claim 2, further comprising an extendable and retractable device for transferring vibrations from the vibration device to a structure in the vicinity of the plugging tool.

4. The plugging tool of any one of claims 1-3, wherein the drilling section comprises drilling means, milling means, or jetting means.

5. The plugging tool of claim 4, further comprising sealing means configured for releasable sealing of the perforations.

6. The plugging tool of claim 5, wherein the drilling section is arranged on the first section.

7. The plugging tool of claim 4, wherein the drilling section is arranged on the first section.

8. The plugging tool of any one of claims 1-3, further comprising sealing means configured for releasable sealing of the perforations.

9. The plugging tool of claim 8, wherein the drilling section comprises drilling means, milling means, or jetting means, and the drilling, milling or jetting tool and sealing means are integrated.

10. The plugging tool of claim 8, wherein the drilling section is arranged on the first section.

11. The plugging tool of any one of claims 1-3, wherein the drilling section is arranged on the first section.

12. A method of plugging a well having at last one tubular having an internal cavity, with the plugging tool of claim 1, the method comprising the steps of:

a) conveying the plugging tool to a desired plugging zone (P) in the tubular;

b) activating a packer arrangement on the second section into abutment with the tubular inner wall, thereby fixating the plugging tool in the tubular;

c) operating the releasable connection means to separate the first section from the second section;

d) flowing a plugging substance through an opening and into the tubing-internal cavity between the second section and the first section;

e) retrieving the first section from the tubular.

13. The method of claim 12, wherein, before step b), one or more first perforations are formed in the tubular wall at a first end of the desired plugging zone, and one or more second perforations are formed in the tubular wall at a second end of the desired plugging zone, and the second perforations are formed between locations of packer arrangements.

14. The method of claim 13, wherein, following or concurrent with step b), the packer arrangement on the first section is activated.

15. The method of claim 14, wherein, following the activation of the packer arrangement on a second packer but before step c), fluids are flowed from the opening, through the second perforations and into a formation outside the tubular, and into the tubular through the first perforations.

16. The method of any one of claims 12-15, wherein the perforations are formed by drilling means, milling means, or jetting means.

* * * * *